United States Patent [19]

Clark

[11] Patent Number: 4,709,605

[45] Date of Patent: Dec. 1, 1987

[54] METHOD OF WORKING SHEET MATERIAL WORKPIECES BY A SHEET MATERIAL WORKING MACHINE TOOL

[75] Inventor: Stephen C. Clark, Williamsville, N.Y.

[73] Assignee: Strippit/Di-Acro-Houdaille, Inc., Akron, N.Y.

[21] Appl. No.: 720,725

[22] Filed: Apr. 8, 1985

Related U.S. Application Data

[60] Division of Ser. No. 52,241, Jun. 26, 1979, which is a continuation of Ser. No. 815,821, Jul. 15, 1977, abandoned.

[51] Int. Cl.[4] ..... B23Q 7/04; B21D 43/11; B21D 43/22; B21D 43/24

[52] U.S. Cl. ..... 83/23; 83/71; 83/405; 83/412; 83/157; 83/367; 83/552; 271/227; 271/171; 271/223

[58] Field of Search ..... 83/23, 71, 412, 413, 83/405, 157, 367, 552, 86, 103; 271/171, 223, 224, 226, 227

[56] References Cited

U.S. PATENT DOCUMENTS

| | | | |
|---|---|---|---|
| 1,367,257 | 2/1921 | Henderson | 271/227 |
| 2,801,692 | 8/1957 | Wright | 83/210 |
| 3,256,761 | 6/1966 | Huntley | 83/412 |
| 3,618,742 | 11/1971 | Blanchard et al. | 198/395 |
| 3,631,750 | 1/1972 | Hanni | 83/157 |
| 3,785,231 | 1/1974 | Lake, Jr. et al. | 83/103 |
| 3,830,121 | 8/1974 | Makeev et al. | 83/81 |
| 3,877,804 | 4/1975 | Hoopner | 355/8 |
| 3,881,605 | 5/1975 | Grossman | 414/730 |
| 3,890,509 | 6/1975 | Maxey | 250/561 |
| 3,908,986 | 9/1975 | Bleau | 271/227 |
| 4,003,478 | 1/1977 | Daniels | 271/226 |
| 4,014,230 | 3/1977 | Eisele | 83/86 |
| 4,033,572 | 7/1977 | Cailloux | 269/320 |
| 4,080,855 | 3/1978 | De George et al. | 83/71 |
| 4,086,860 | 5/1978 | Kosrow et al. | 271/227 |
| 4,089,517 | 3/1978 | Marass | 271/227 |
| 4,123,733 | 7/1980 | De George et al. | 271/277 |
| 4,127,198 | 10/1978 | Morini | 271/227 |

FOREIGN PATENT DOCUMENTS

| | | |
|---|---|---|
| 288112 | 2/1975 | Austria . |
| 2359918 | 6/1974 | Fed. Rep. of Germany . |
| 2536525 | 2/1977 | Fed. Rep. of Germany . |
| 48-15174 | 2/1973 | Japan . |
| 4318673 | 12/1973 | Japan . |
| 49-4268 | 1/1974 | Japan . |
| 49-96388 | 9/1974 | Japan . |
| 50-82683 | 7/1975 | Japan . |
| 1322854 | 7/1973 | United Kingdom . |

OTHER PUBLICATIONS

German publication entitled, "VDI Guide Lines", Mar. 1965.

German publication entitled, "Automation In The Press Shop", Sheet Metal Industries, May, 1975.

*Primary Examiner*—Donald R. Schran

*Attorney, Agent, or Firm*—Hill, Van Santen, Steadman & Simpson

[57] ABSTRACT

An automatic material loading, positioning and unloading system is disclosed in connection with a machine tool turret punch. The device includes a loader which receives a stack of sheets to be fed to the punch machine. The loader includes means for lifting the sheets one at a time from a storage area, means for transporting the sheets to a loading area of the punch worktable and means for unloading the sheets at the worktable area. The punch machine includes automatically controlled workpiece grippers which receive the sheets from the loader, properly position them with respect to the machine tool, move them in a predesired sequence through the machine and transport them to an unload area of the worktable. The unload area of the worktable is effective to discharge the punched sheets from the machine to an unload stacker. The unload stacker receives and stacks completed sheets. The loader, grippers, turret punch, unload area and unload stacker all cooperate together to provide a fully automatic machine tool device capable of operating under automatic control to process a large number of workpieces one at a time.

26 Claims, 10 Drawing Figures

METHOD OF WORKING SHEET MATERIAL WORKPIECES BY A SHEET MATERIAL WORKING MACHINE TOOL

This is a division of application Ser. No. 052,241, filed June 26, 1979, which is a continuation of Ser. No. 815,821, filed July 15, 1977, now abandoned.

BACKGROUND OF THE INVENTION

1. Field of the Invention

This invention relates to machine tools and more particularly to an automatic workpiece handling system including a machine tool, an automatic workpiece loader for the tool, automatic workpiece positioning means and an automatic completed workpiece unloader.

2. Prior Art

In recent years automated machine tools have become widespread. A particularly successful automation has occurred in connection with high speed turret punches. These punches include relatively large devices having upper and lower spaced apart tool carrying turrets which are maintained in position adjacent a workpiece supporting worktable. The worktable may be equipped with workpiece gripping members which are capable of moving a workpiece in both an X and Y axis with respect to a work station of the turrets. Both the workpiece gripping members and the turrets are controlled from an automatic control center, either a tape read system or a computer such that once a workpiece is properly positioned in the workpiece gripping members and the members properly positioned with respect to the work station, the machine tool can perform a large number of sequential punching operations on the workpiece at precisely determined positions. Upon completion of the desired sequence of punching operations (piece program), the gripping members are normally programmed to return the completed workpiece to a position on the worktable which facilitates unloading of the completed workpiece and loading of a new workpiece.

As such automated turret punches become increasingly improved, it has become practical to operate them totally unattended from the time of initial loading and positioning of the workpiece until completion of the piece program. However, loading, positioning and unloading of successive workpieces remains a manual operation which both adds an unnecessary cost to the manufacture of a large number of identically punched parts while at the same time reduces the manufacturing speed attainable.

Therefore, it would be an advance in the art to provide some construction embodying a machine tool such as a turret punch which was capable of automatically self-loading and unloading. However, due to the criticality of positioning of the workpiece with respect to the work station of the machine, it has not heretofore been practical to contemplate automatic loading devices. Additionally, because of the size of the workpiece will vary from production run to production run, normal product handling systems are not adaptable to automatically load machine tools. An additional factor which works against any attempt to provide an automatic load system results from the fact that machine tools, and particularly turret punches, work with large, unwieldy and heavy workpieces. For example, presently available standard turret punches can handle mild steel sheets on the order of 40" by 96" by $\frac{1}{4}$" having a weight per sheet of approximately 270 pounds. A more popular size of workpiece may involve sheets on the order of 40" by 60" of 10 gauge mild steel which would weigh on the order of 100 pounds a sheet.

Because of the common usage of such awkward sheet sizes and the weight thereof, it has previously been suggested to provide loading assistance devices. Such prior devices have normally involved constructions which would assist the worker in lifting or dragging a workpiece onto the machine wool worktable. One such prior art device included pneumatic sheet attaching means attached to cables which terminated at a position overlying a portion of the worktable. While such devices have heretofore been useful in assisting in loading large, uniform sized, workpieces, they have neither been automated nor adaptable to varying workpiece sizes.

Additionally, such prior art loaders have not functioned as time saving devices in that upon placing the workpiece on the worktable, the workpiece still had to be moved into the proper position with respect to the workpiece gripping members and the workpiece positioning side gauge. Additionally the operator had to raise and lower the side gauge and open and close the workpiece grippers before the piece program could be initiated.

Prior art automatically controlled machine tools utilize workpiece gripping members which are movable in an X and a Y direction with respect to the work station centerline. The control device keeps track of the position of the workpiece gripping members and can therefore be said to know the position of the workpiece with respect to the work station once the workpiece has been properly initially positioned and clamped in the gripping members. This initial positioning has normally been accomplished by causing the gripping members to move over the worktable to an initial load position which is known within the controller as the X and Y axis base line or 0 position. The workpiece is then placed on the table in front of the gripping members and the gripping members are cycled to an open position. Since the workpiece is generally rectangular having at least one pair of right angle adjacent sides, positioning, or gauging, is accomplished by moving the front edge of the workpiece backwards into the open grippers until that edge bottoms in each of the grippers. The workpiece is then moved sideways in the grippers until its side edges adjacent the front edge received in the grippers, encounters a fixed abutment precisely positioned on the worktable. The abutment is normally manually projected above the table surface. At this point, with the front edge bottomed in the grippers and the side edge abutting the side gauge projection, the positioning of the workpiece is determined and in view of the control's knowledge of the positioning of the grippers, the control can now be said to have knowledge of the positioning of the workpiece. The grippers are then manually closed and the side gauge manually lowered.

Upon completion of the piece program, it has been known in the art to have unloading assists which, in the manner of the loading assists, grab the completed workpiece and drag it off of the worktable. However the prior art had not been able to automate such devices and relied upon the operator to assure that the workpiece was free of obstruction by elements of the machine including the gripping members and to initiate actuation of the unload assist.

Thus, although the actual sequencing of the workpiece through the punching operation, the selection and alignment of the punches and termination of the operation were all automated, the art has not been able to eliminate the necessity for a full time operator who is required to move the workpiece onto the table, whether assisted or unassisted by machinery, to align the workpiece with respect to the machine in both the X and Y axis, to secure the aligned workpiece to the workpiece gripping members, to clear the workpiece side gauge, to initiate the piece program cycle, to disengage the workpiece from the gripping members, to clear the workpiece from obstruction by the machine and to remove the workpiece from the workpiece table whether assisted or unassisted by machinery.

It would therefore be an advance in the art to provide a substantially completely automated machine tool assembly having means for: isolating a workpiece from a workpiece storage, moving the isolated workpiece to the machine tool worktable, gripping the workpiece by the workpiece gripping members, gauging the workpiece in both the X and Y axis, sequencing the workpiece and the machine tool through the piece program of the machine tool for that workpiece, disengaging the workpiece from contact with the machine tool and unloading the workpiece from the machine tool worktable to a finished product storage area and repeating the sequence without any intervening operator assistance.

SUMMARY OF THE INVENTION

This invention overcomes the disadvantages of the above described prior art and provides such a fully automated machine tool system. The system, in the preferred embodiment, as hereinafter described, includes a machine tool turret punch of the type which has a workpiece gripping carriage including gripping members movable in an X axis, the gripping carriage being carried by the tool in association with moving worktable portions movable in the Y axis. Movement of the carriage, moving worktable portions and turret indexing the punch operation are all controlled by an NC controller.

To this presently available system, this invention associates a loading device, an X axis gauge system, a Y axis gauge system and an unloading device all of which are controlled by the NC and which interact together to virtually eliminate the necessity of a full time machine operator.

As more fully described in connection with the description of the preferred embodiment, I have determined that a critical aspect of a fully automated load-work-unloaded system is the ability to properly position the workpiece with respect to the machine tool before initiation of the piece program. Further, I have determined that this positioning is preferably independent of the loading mechanism. By making the positioning independent of the loading mechanism, I have avoided the extremely difficult problems associated with creation of a loading device capable of handling a wide variety of sizes and weights of workpieces and positioning them all accurately on the worktable.

Instead, I have provided a versatile loading device capable of picking up workpieces one at a time from a stack of workpieces and depositing them in a given general area of the worktable. Thereafter I accurately position the workpiece with respect to the machine tool by use of the same gripping mechanism which will thereafter move the workpiece during the production sequence.

Further, I have found that unloading can be easily accomplished by causing the workpiece gripping members, upon completion of the piece program, to move the workpiece to a predetermined area of the table, clear of any machine tool overhang and to thereafter deposit the completed workpiece on that area of the table and to withdraw from contact with the workpiece. Thereafter the unload of the workpiece can be accomplished without further reference to either the machine tool or the workpiece gripping members or to the loading device. In fact, in the preferred embodiment illustrated, loading can occur simultaneously with unloading since the functions are carried out on opposite sides of the worktable.

The loading device preferably includes a frame defining an internal stack area for receipt of a pallet containing a stack of workpieces. Mounted atop the frame, and above the stack is a linearly movable carriage including a rail cantilevered from the frame to a position over the worktable at one side of the machine tool center line, the carriage being movable from over the stack to over the worktable. The carriage supports a vertically movable head which carries a number of workpiece engaging pneumatic cups. The loading device functions to load individual sheets from the stack by allowing the head to descend to engage the top workpiece in the stack by the cups, thereafter applying a suction and then raising the head to position the workpiece at a level slightly above the surface of the worktable. The carriage is then transported to a position over the worktable where the head descends to place the workpiece on the worktable. Suction is terminated and the workpiece is disengaged from the cups. Gauging in the Y axis is then carried out. The head thereafter is withdrawn towards the carriage and the carriage is withdrawn to a position over the stack within the frame. X axis gauging is then carried out.

The workpiece is positioned, or gauged, by first moving the workpiece gripping carriage in both the X and Y axis to a known base position adjacent the area of deposit of the workpiece. The gripping members are thereafter moved in the Y axis with the clamps open, a predetermined distance. At that distance the presence of the workpiece edge in engagement with the clamping members is sensed and the clamps are closed. This movement of the clamping members in the Y axis direction and sensing of the presence of the workpiece in the clamps at a known position on the Y axis automatically positions the workpiece in the Y axis.

Positioning of the workpiece in the X axis is accomplished by moving the workpiece gripping members with the Y axis positioned workpiece held by the gripping members in the X axis until the workpiece is engaged against a movable stop member. Engagment of the workpiece against the movable stop member causes the movable stop member to move to a known position, at which position the X axis reference can be set in the gripping carriage movement control. This setting of the X axis direction reference thus properly positions the workpiece along the X axis.

A particularly preferred mechanism for setting the X axis positioning is described in the co-pending application of Robert Paul DeGeorge, Paul Rice Brown and Victor Thomas Carbone, Ser. No. 720,803, filed Sept. 7, 1976 now Pat. No. 4,213,733 issued July 22, 1980.

After precisely determining the proper positioning of the workpiece, the workpiece can, as is normal, be moved through a piece program sequence with respect to the machine tool. Upon completion of the production sequence, the workpiece gripping members are programmed to move the completed workpiece to a side portion of the worktable, preferably opposite the loading side. The workpiece is then deposited upon the table portion in an area where the workpiece is free of any machine tool overhang. Thereafter the gripping carriage is withdrawn to a point remote from the workpiece at which point a signal is sent to the NC control allowing actuation of an unloading device.

In the preferred embodiment described herein the unloading device consists of a hinged side section of the worktable which is provided with a power means for tilting the section to an edge down position (tip table section). Since the worktable is normally equipped with anti-friction devices such as roller balls, the completed workpiece will roll off of the tilted portion of the table and into a sheet stacking device which automatically stacks finished sheets onto a pallet.

The preferred embodiment of the tip table is fully described in the co-pending application of Robert P. DeGeorge and Paul R. Brown, Ser. No. 719,825, filed Sept. 2, 1976, now U.S. Pat. No. 4,080,855 the teachings of which are herein incorporated by reference.

Operation of the loading device, gauging or positioning of the workpiece with respect to the machine tool, piece program and unloading are all controlled by the NC. Additionally the system is provided with a number of inhibits preventing actuation of certain portions in dependent response to sensed conditions existing in other portions.

It is therefore a principal object of this invention to provide a fully automated machine tool capable of self-loading, self-aligning, workpiece production and self-unloading.

It is a more particular object of this invention to provide a turret punch machine tool which is capable of withdrawing workpieces from a stack of workpieces, performing a sequence of operations on the workpiece and depositing the completed workpiece in a stack of completed workpieces.

It is a more specific object of this invention to provide an automatic turret punch machine tool having a worktable with automatically controlled workpiece gripping members movable thereover to position any portion of a gripped workpiece with respect to the work station of the punch, the machine tool being provided with an automatic loading device capable of separating a workpiece from a storage stack of workpieces raising the workpiece to a table level, moving the workpiece to a position over the table, depositing the workpiece on the table in an area to be gripped by the workpiece gripping members and withdrawing from a position of possible interfernece with further operation of the machine tool, the machine tool being further equipped with automatically controlled devices for properly and adequately positioning the workpiece in the gripping members and setting reference points in the control for both X and Y axis of the gripping carriage at points corresponding to the position of the workpiece; the machine tool being further equipped with a mechanism for moving the completed workpiece to an unload area of the worktable, sensing deposit of a workpiece on the unload area of the worktable and withdrawing the gripping carriage from contact with the workpiece, and thereafter automatically unloading the completed workpiece from the worktable to a completed workpiece stacking device.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

DESCRIPTION OF THE PREFERRED EMBODIMENTS

Figure 1:
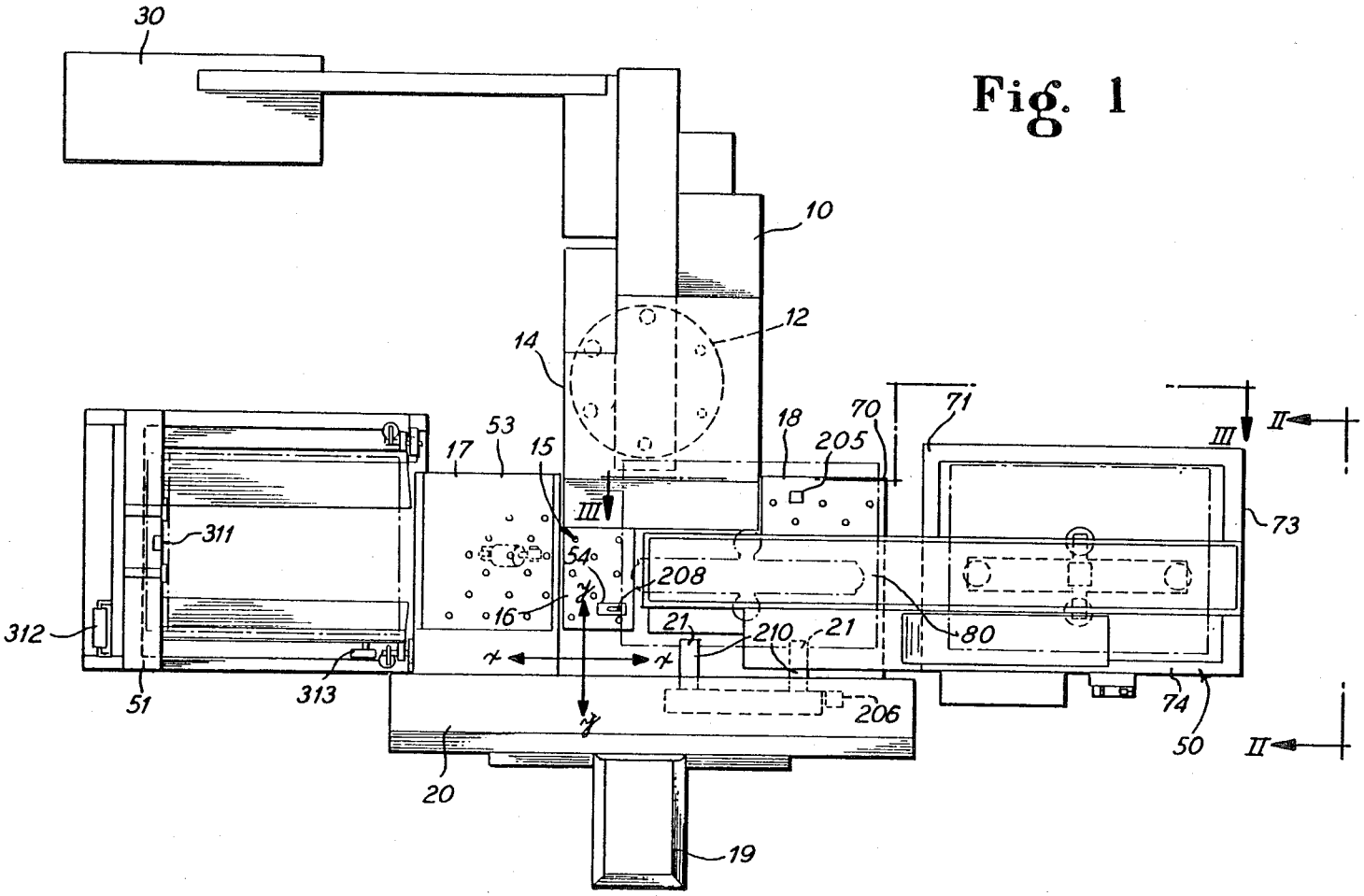
FIG. 1 is a top plan view of a turret punch machine tool equipped with the automatically controlled workpiece load, workpiece gauge and workpiece unload devices of this invention.
Figure 4:
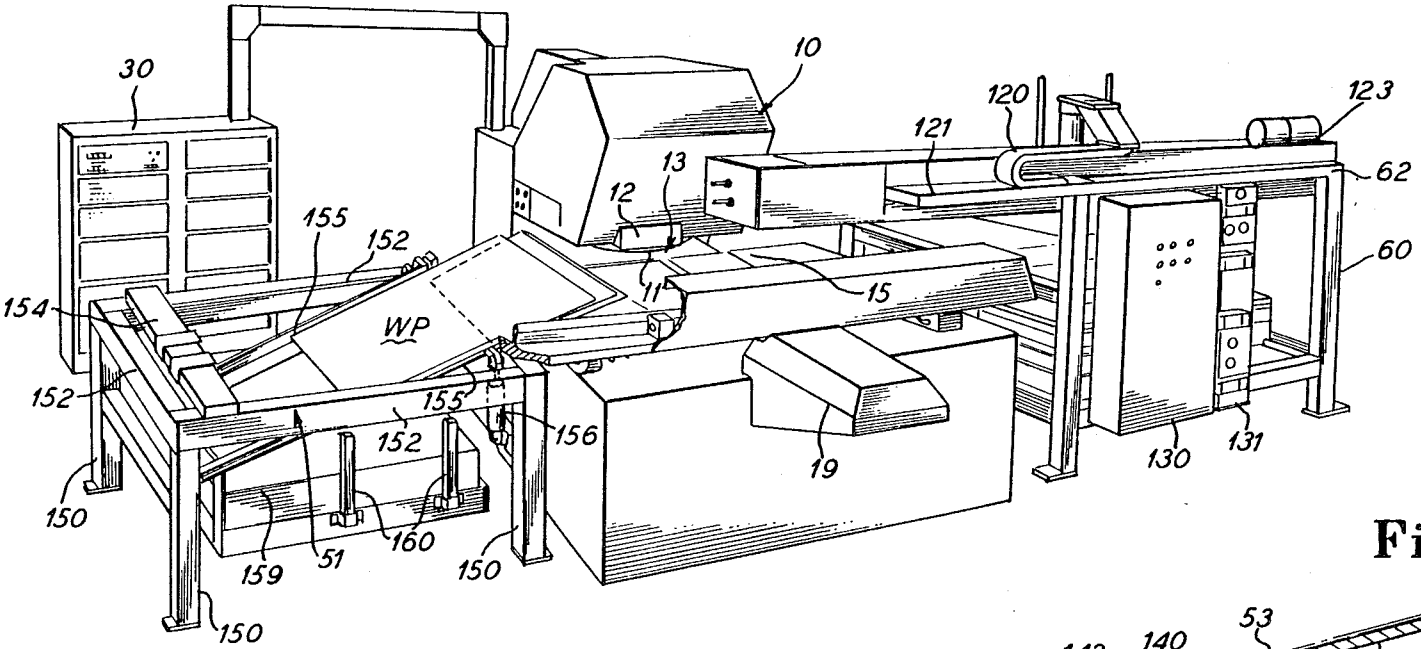
FIG. 4 is a perspective view of the assembly of FIG. 1.

As best illustrated in FIGS. 1 and 4, this invention is adapted for use in association with machine tools and more particularly with turret punches 10. Such turret punches comprise a punching station and include lower 11 and upper 12 spaced apart turrets containing respectively dies and punches with the turrets being rotatable to present any given set of punch and die at a work station 13. Positioned in front of the turret assembly housing 14 is an elevated worktable 15 which includes a stationary central portion 16 and in and out movable side portions 17 and 18. Movement of the side portions 17 and 18 is controlled by a motorized lead screw 19. A horizontally movable gripping carriage 20 is carried by the movable worktable portions 17 and 18 for movement therewith. The carriage 20 carries horizontally movable workpiece clamping means in the form of gripping members 21.

As is well known to the art, movement of the workpiece gripping members 21, the moving worktable portions 17 and 18 and the turrets 11 and 12 is controlled by a control means 30 which may be an NC, a punch tape reader, or a computer.

The particular control 30 to be utilized in association with this invention forms no part of the invention and standard available controllers may be utilized. For example an HC1000A control commercially available from Houdaille Electronics Division of Houdaille Industries, Inc. has proven to be usable in association with my invention requiring modification only to accept additional inhibit or command inputs and outputs. It is apparent that any person skilled in the art of designing machine tool controls will be able to provide control hardware and software to effectuate control of the devices as hereinafter described and therefore no attempt will be made to describe the construction of the control.

In the practice of this invention, an automatic workpiece loading device or magazine 50 is positioned adjacent one side of the worktable 15 and a workpiece stacking device or magazine 51 is positioned adjacent the other side of the worktable 15. The side of the table associated with the stacking device 51 is equipped with a tipping edge section 53 of the type described in the aforesaid application U.S. Pat. No. 4,080,855.

Additionally, the machine tool is provided with an automatic side gauge mechanism 54 of the type described in the aforesaid Ser. No. 720,803, the side gauge 54 including a switch 208. Further the gripping members 21 are provided with pressure sensing switches 210 and the carriage 20 is provided with an X axis gripping carriage position sensing switch 206 while the moving table portion 18 is provided with a Y axis position sensing switch 205 which may, for example, be actuated by a cam land on a base underlying the moving table portion. A sensing switch 207 is positioned adjacent the tip table section 53 and is effective to sense when the tip table is in a tipped condition. The addition of the tip table 53, the side gauge 54 and the sensing switches 205, 206, 207, 208 and 210 and the loading device, stacking device and control changes represent the only modifications from the state of the art turret punch machine tools necessary for the practice of this invention.

Figure 2:
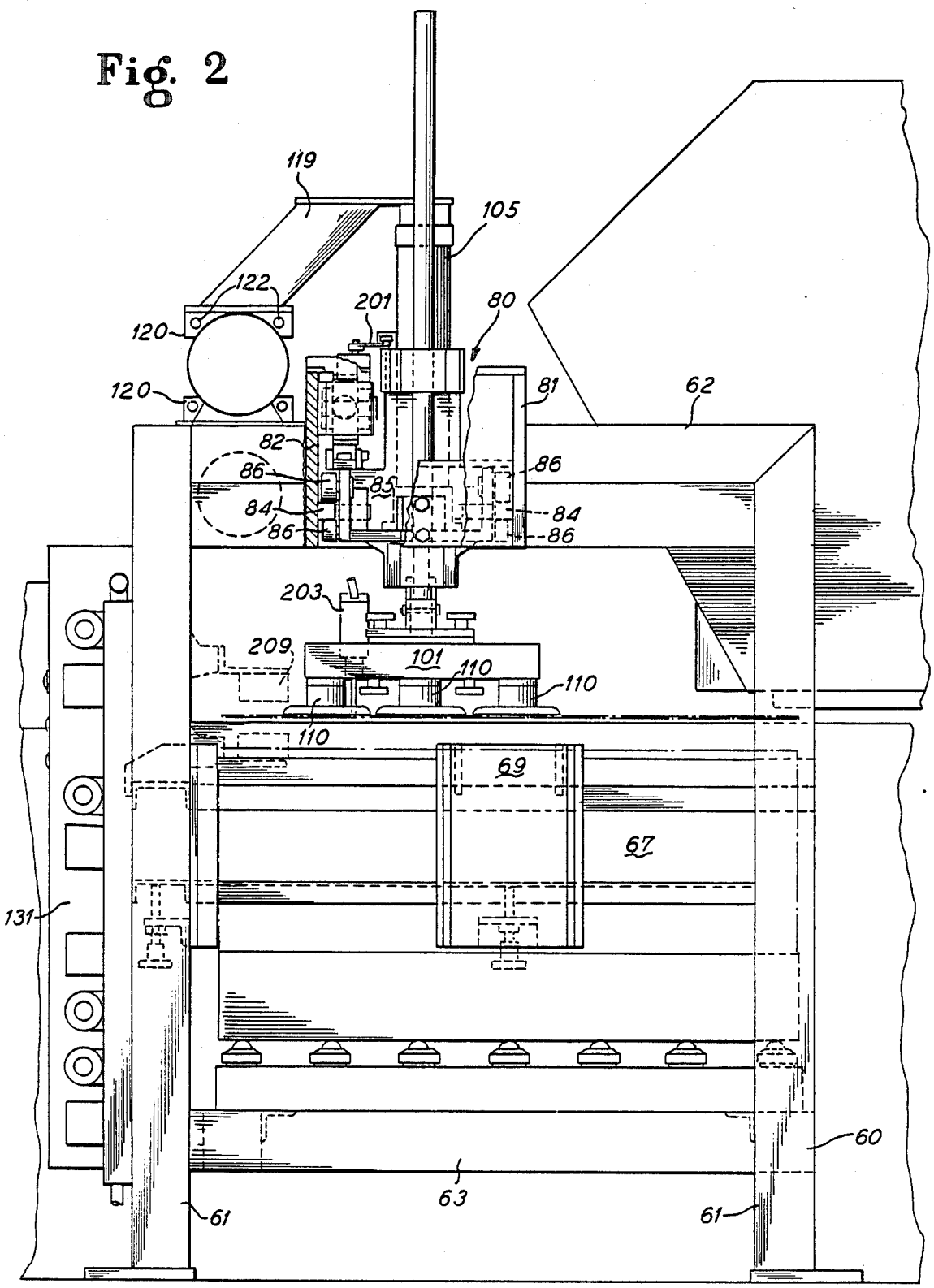
FIG. 2 is an end elevational view of the loading device taken along the lines II—II of FIG. 1.
Figure 3:
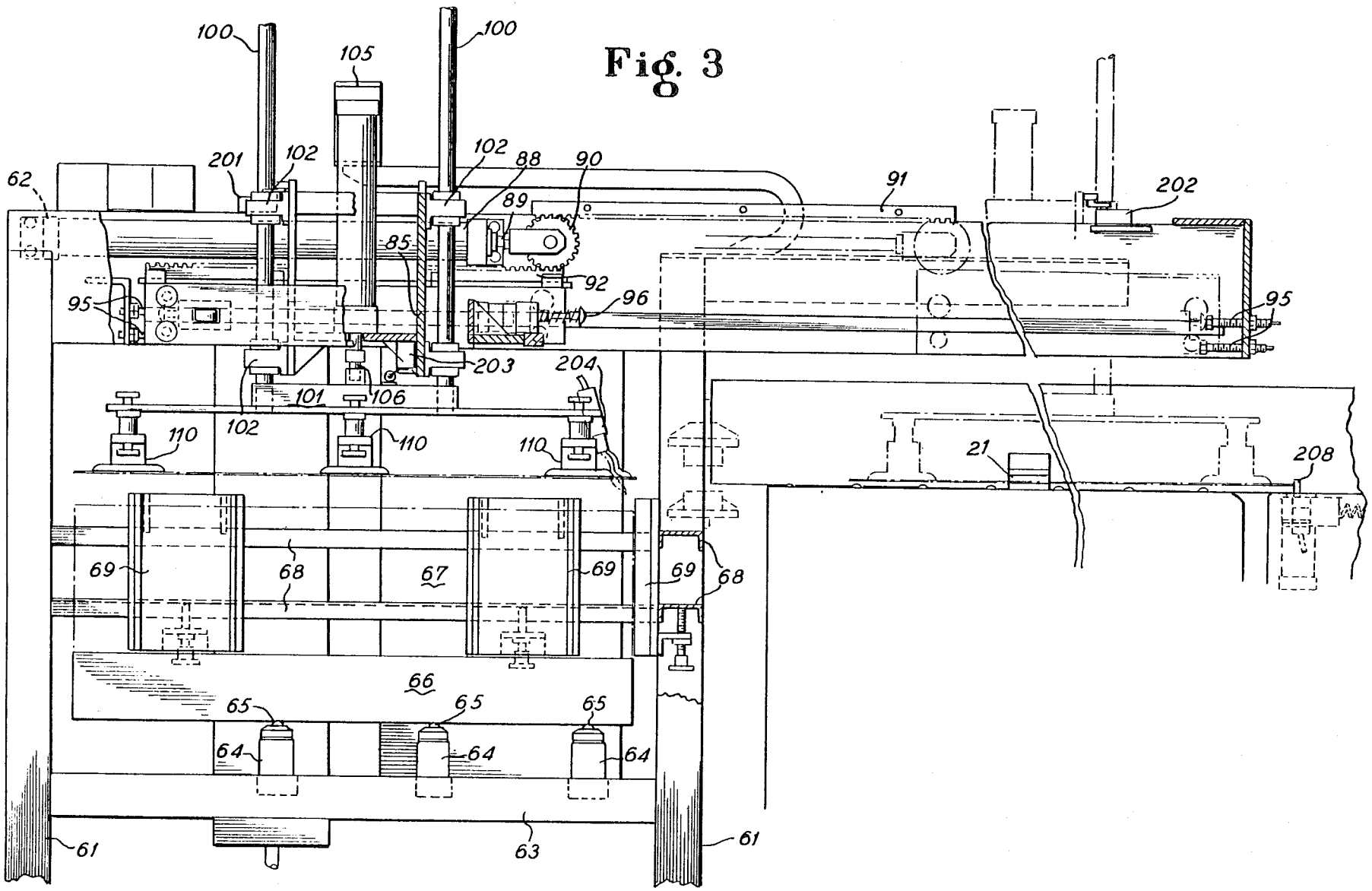
FIG. 3 is a back elevational view, partially in section, of the loading device taken along the lines III—III of FIG. 1.

As best shown in FIGS. 2 and 3 the workpiece loading device comprises a frame 60 including spaced uprights 61 capped by top rails 62 and supporting buttom rails 63. The bottom rails 63 are equipped with bed members 64 having anti-friction means 65 thereon for receipt of a pallet 66 containing a stack 67 of workpiece sheets. If desired a pad may be interposed between the anti-friction means 65 and the pallet 66. Two sides of the frame enclosed area carry spaced parallel rails 68 on which are adjustably positioned sheet fanning magnets 69.

In order to provide adequate access to the corner 70 of the machine tool, the corner 71 of the frame has the side upright 60 extending only partway up. Thus the top rails 62 extend fully only on sides 73 and 74. Extending crosswise of the loader frame and cantilevering out over the table of the machine tool is a carriage track 80 including parallel walls 81 and 82 welded to the top rail 62 on the side 63 which, in turn, internally support inwardly projecting track pieces 84 on which a carriage 85 is mounted by means of rollers 86 such that the carriage is movable along the length of the carriage track from a position over the stack 67 to a position overlying approximately half the machine tool workpiece support table.

The carriage 85 is power moved by a double acting cylinder 88 having a power arm 89 terminating in a rotatable pinion 90. A fixed rack 91 carried by wall 82 overlies the pinion 90 and extends partway along the length of the carriage track 80. A moving rack 92 underlies the pinion 90 and is affixed to the carriage 85. Thus actuation of the cylinder 88 to extend the power arm 89 will cause movement of the carriage in the direction of movement of the power arm 89 with carriage 85 movement being twice power arm movement. Adjustable stops 95 at both ends of the tracks 84 cooperate with shock absorbers 96 affixed to the carriage 85 to limit movement of the carriage at the ends of the carriage track 80.

The carriage 85 has linear motion bushings 102 attached thereto through which parallel vertically disposed bushing rods 100 project. Rods 100 are affixed to a head member 101 positioned below the carriage and movable therewith. A double acting cylinder 105 carried by the carriage 85 has a power arm 106 attached to the head 101.

A plurality of pneumatic cups 110 are attached to and depend from the head 101 overlying the area of the stack 67 when the carriage is in the position illustrated in FIGS. 2 and 3.

Hydraulic and electric power is supplied to the carriage 85 and head 101 through a channel 119 affixed to the cylinder 105 and movable therewith. The channel 119 is attached to a hairpin shaped self-laydown cat track 120 supported on a shelf 121 paralleling the carriage track 80. The cat track has electric and hydraulic conduits 122 extending therethrough, some of which are connected to a vacuum pump assembly 123 mounted atop the frame. A control panel 130 and a valve back panel 131, best illustrated in FIG. 4, are also mounted to the frame.

The unload device includes tip table section 53 hinged at 140 to the moving table portion support 141. A double acting valved cylinder 310 connected respectively to the support 141 and to the table portion 53 operates to selectively pivot the tip table 53 to an outside edge 142 down position such that a workpiece WP resting on the tip table 53 will be discharged to stacker 51. The stacker 51 is a four posted 150 frame having four cap rails 152 and a vertical height sufficient to position and remove a pallet from thereunder. Attached to the cap rails is a back wall and stop member 154 which is movable along the side cap rails towards and away from the machine tool worktable. Inclined angle rails 155 are affixed to the frame interior of the cap rails and at least one inclined rail 155 is adjustable towards and away from the other inclined rail. The inclined rails are preferably L-shaped rails and are mounted for longitudinal rotation with rotation being controlled by double acting cylinders 156 supported on the frame and having power arms 157 attached through a bracket 158 to the rotatable rails 159. The rails are initially spaced apart a distance equal to the width of the workpiece WP with slight clearance with one leg of the L shape turned inwardly towards the opposed rail forming a receipt land for the workpiece WP being discharged from the tip table 53.

Unload is accomplished by tipping the tip table 53 to slide the workpiece WP onto the inclined rails 155 which, due to the incline will allow the workpiece to continue its outward and downward movement away from the worktable 15 until it contacts the stop 154 which has been adjusted to a position dependent upon the length of the sheets being run. Thereafter the rails 155 are rotated inwardly to allow the sheet to drop to the pallet. The pallet may be equipped with vertical guides 160 to assist in guiding the sheet to the area of stacking on the pallet. Air resistance to the drop of the sheet aids in controlling the fall rate.

Operation of the loading device, the gauging and the unloading device and stacking member are all influenced by switches and controlled by valves under the direction of the control 30. The loading device is provided with a switch 201 for sensing positioning of the carriage over the stack 67 at one end of the carriage track 80 while a switch 202 senses positioning of the carriage over the machine tool support table at the other end of the carriage track 80. A switch 203 carried by the carriage 85 senses a raised positioning of the head 101 while a switch 204 carried by the head 101 senses engagement of the cups 110 with a workpiece.

Switch 205 senses positioning of the workpiece clamp carriage 20 at a position on the Y axis withdrawn away from the turrets 11 and 12 while switch 206 senses positioning of the clamps 21 at a position on the X axis withdrawn away from the tip table and adjacent the loader. Thus the Y axis positioning of the work clamps can be determined from switch 205 while the X axis positioning of the clamps can be determined from switch 206.

Figure 5:
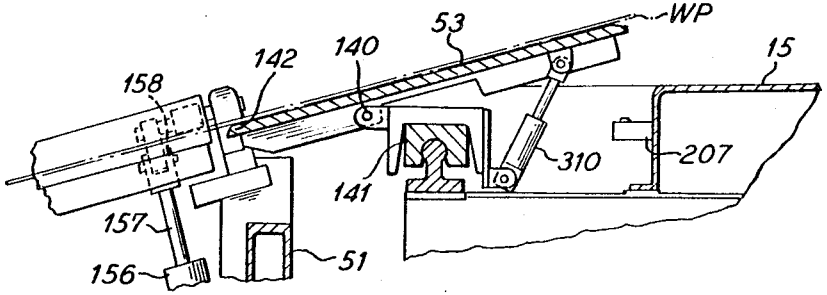
FIG. 5 is a fragmentary sectional view of the tip table section of the worktable and the workpiece receiving section of the stacking device.

Switch 207, best illustrated in FIG. 5, carried by the worktable 15, senses whether the tip table 53 is in an untipped condition. Switch 208 is activated when the side gauge 54 is contacted by a workpiece being moved by the clamps 21. Switch 209, illustrated in FIG. 2, carried by the loading device frame, comprises a transmitter-receiver double sheet sensing device indicating if the head 101 is transporting more than one sheet. Switches 210 are pressure sensitive switches carried by the workpiece gripping members 21 at a back of a throat opening of the members and detect of the presence of a workpiece having an edge fully bottomed in the gripping members.

Figure 6:
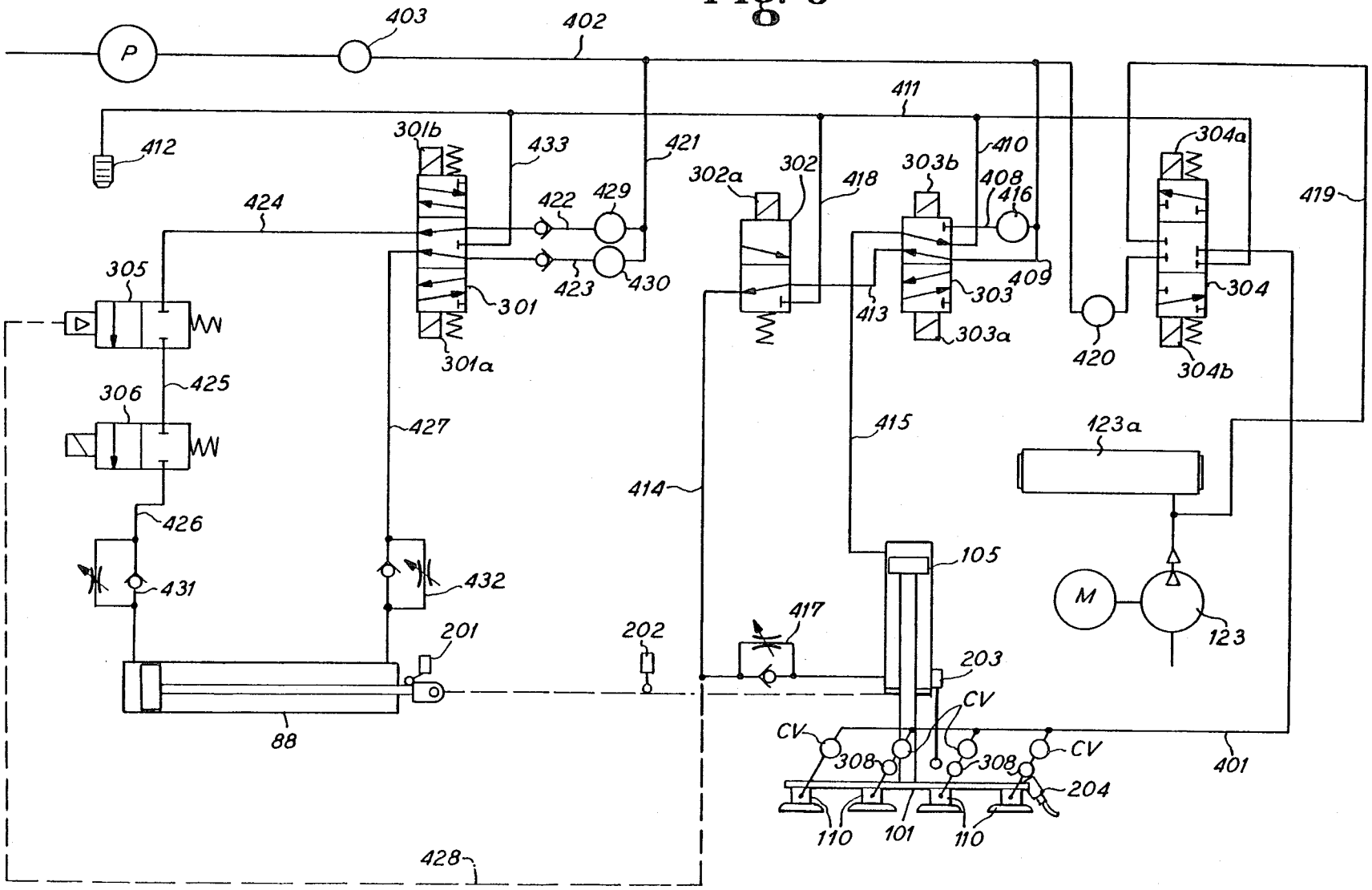
FIG. 6 is a diagrammatic flow chart of a hydraulic control system for the loader.

As best illustrated in FIG. 6, movement of the loading device carriage 85 and head 101 as well as activation of the cups 110 is controlled by solenoid activated valves 301, 302, 303 and 304 mounted or valve panel 131. Blocking valves 305 and 306 cooperate with valves 301 and 302 to prevent loader carriage movement at inappropriate times as is more fully hereinafter described.

Valves 308, in pneumatic line 401 to the cups 110 are individually actuatable to block or open line 401 to the individual cups allowing selective usage of the cups depending upon the size of the workpiece being loaded. Valve 309 carried by the carriage 20 activates the workpiece clamping members 21. Valve operated cylinder 310, illustrated in FIG. 5, operates the tip table while valves 311, 312 and 313 on the stacker 51 cooperate to control rotation of the rails 155.

OPERATION OF THE LOADING DEVICE HYDRAULIC CIRCUIT

As best illustrated in FIG. 6, hydraulic pressure is provided to the loading device 50 through line 402 from a factory air pressure source with pressure controlled by a regulator 403. Raising and lowering of head 101 through cylinder 105 is controlled by valves 302, and 303. Air pressure from line 402 is supplied by lines 408 and 409 to two position spool valve 303 while exhaust to atmosphere is provided by line 410 from spool valve 303 to line 411 open to the atmosphere through muffler 412. In the position of spool valve 303 illusrated, line 409 is communicated to line 413 which in turn communicates to two position spool valve 302 which opens line 413 to line 414 in communication with the bottom of cylinder 105. Thus with spool valves 302 and 303 in the position illustrated, head 101 will be raised and the top half of cylinder 105 will be exhausted through line 415 through spool valve 303 to line 410. Upon activation of solenoid 303*a* and deactivation of solenoid 303*b*, line 415 will be communicated to line 408 which, through pressure regulator 416, is in communication with pressure line 412 while exhaust line 410 will be communicated to line 413. In this position of valve 303, pressure will be supplied to the top of cylinder 105 while the bottom of cylinder 105 will be exhausted through line 414 through variable regulator 417 and therefore head 101 will descend.

By maintaining 303 in the position illustrated in FIG. 6 but activating solenoid 302*a* to shift the spool valve 302, the bottom of cylinder 105 can be vented to atmosphere through regulator 417, line 414 and line 418 to line 411 while pressure is not being provided to the top of cylinder 105. In this mode, head 101 descends by gravity against the resistance of regulator 417. This mode is used when head 101 is positioned over the worktable with a workpiece carried by cups 110 for deposit of the workpiece on the worktable. This allows gentle deposit of the workpiece on the table without forcing the workpiece to depress the spring loaded anti-friction rollers on the table to a point which would interfere with the ability of workpiece gripping members 210 to engage the workpiece.

Vacuum pump 123 operates through accumulator 123*a* to provide vacuum to line 419 to three position spool valve 304 which is in communication with exhaust line 411 and pneumatic line 401 as well as pressure line 402 through regulator 420. When solenoid 304*a* is operated to move spool valve 304 downward from the position illustrated, vacuum line 419 will be in communication with pneumatic line 401 providing suction to the cups 110. When solenoid 304*b* is operated to move spool valve 304 vertically up from the position illustrated in FIG. 6, pressure line 402 will be communicated to pneumatic line 401 to blow off a workpiece carried by cups 110.

Movement of the carriage 85 is controlled by a cylinder 88 which in turn is controlled by three position spring centered spool valve 301. When it is desired to advance the carriage, solenoid 301a is actuated communicating pressure line 402 through line 421 pressure regulator 429 and line 422 to line 424 which, in turn, connects through pilot valves 305 and 306 and lines 425 and 426 and variable regulator 431 to provide pressure to the left hand side of cylinder 88 in the view shown in FIG. 6 to advance carriage 85 towards the worktable. At the same time, line 427 in communication with the right hand side of cylinder 88 through variable resistance 432 is communicated to line 433 to exhaust line 411. Pilot valve 305 is operated as a spring biased closed valve openable only when pressure exists in line 414 indicating the head 101 is in a raised position. This prevents movement of the carriage when such movement could damage head 101. Pilot valve 306 is a normally closed solenoid activated valve which is advanced to an open position by the controller 30. During normal operating conditions pilot 306 is maintained in an open condition during all normal operating conditions, however, it will be unpowered and therefore spring closed anytime an emergency stop of all hold signal is given to the controller 30 or whenever electric power is lost within the system.

When spool 301 is in the centered position illustrated in FIG. 6 and pilots 305 and 306 are open, cylinder 88 will be maintained in a hold condition so long as regulators 429 and 430 are balanced to compensate for the difference in surface area on opposed sides of the piston of cylinder 88.

When it is desired to retract head 101 to a position over the stack 67, solenoid 301*b* is activated to communicate line 427 to line 423 through regulator 430 to line 421 to pressure line 402. At the same time, line 424 is communicated to line 433 to exhaust line 411 thereby exhausting the left hand side of cylinder 88.

STEP BY STEP OPERATION OF INVENTION

Figure 7:
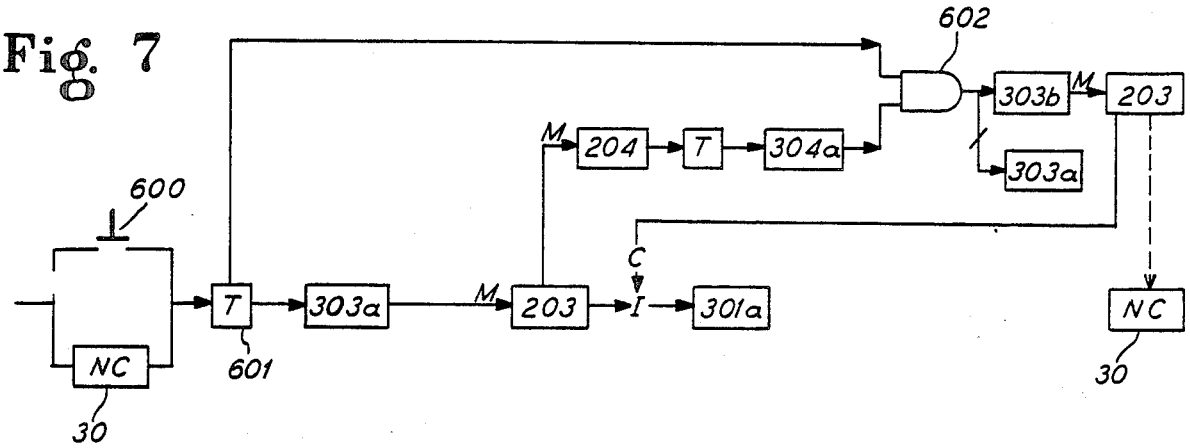
FIG. 7 is a diagrammatic flow chart of a first operating phase of the loading device.
Figure 8:
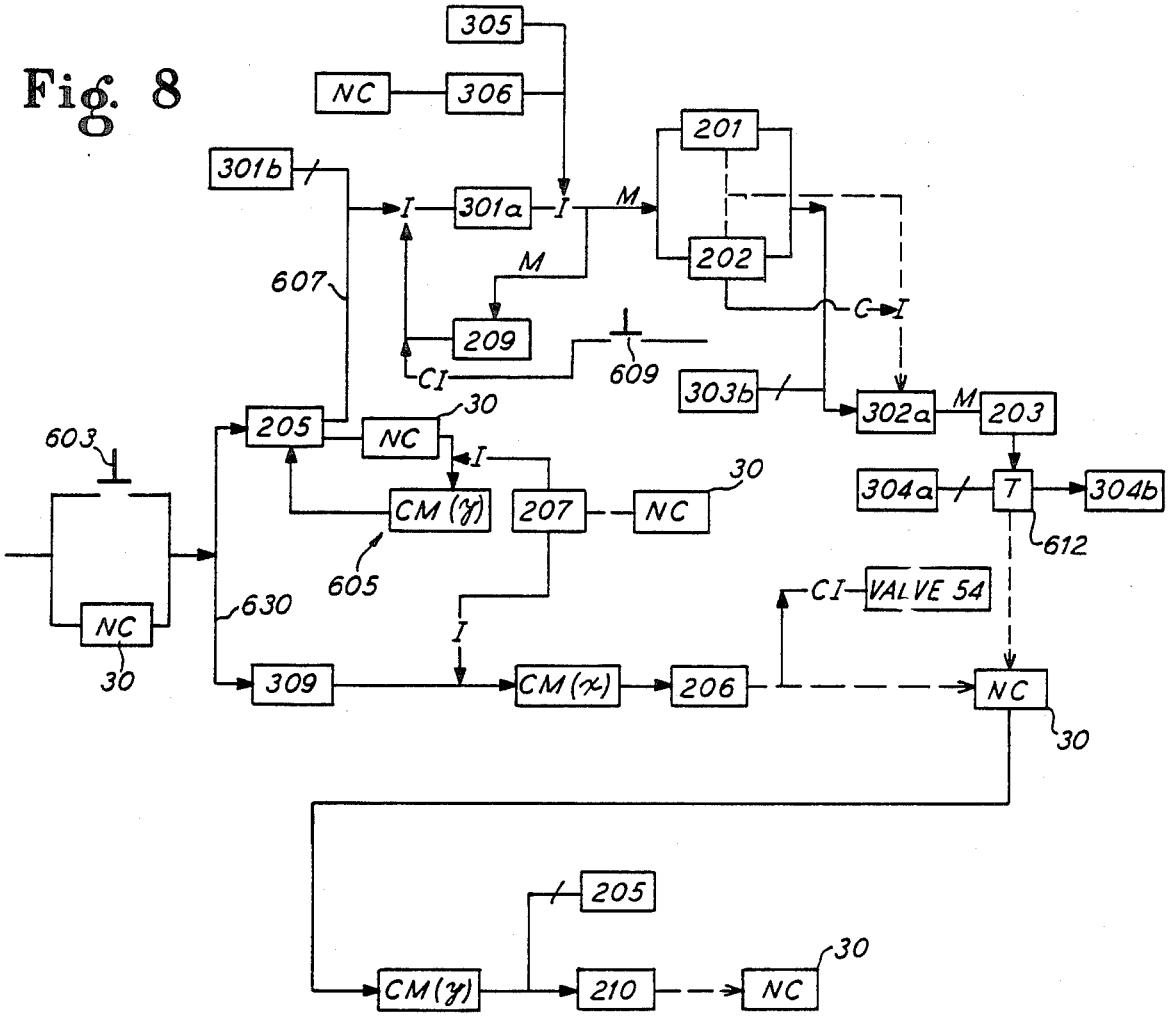
FIG. 8 is a view similar to FIG. 7 illustrating a second operating phase of the loading device and a first gauging phase.
Figure 9:
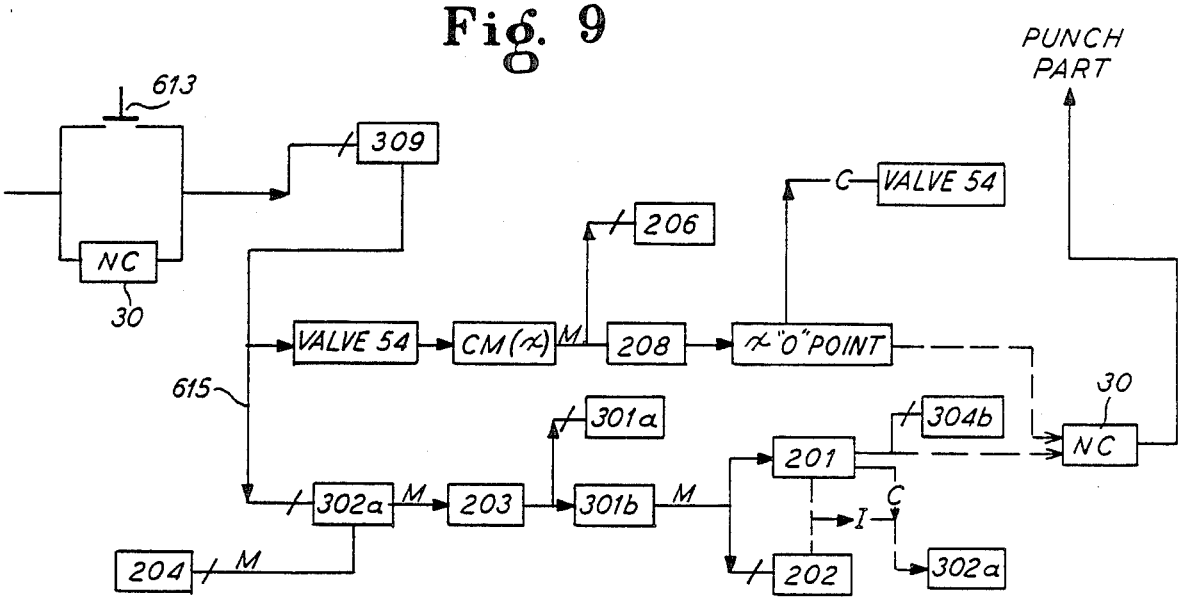
FIG. 9 is a view similar to FIG. 8 illustrating a third operating phase of the loading device and a second gauging phase.

FIGS. 7 through 10 diagrammatically illustrate the automatic operation of the loading device, workpiece gauging and the unloading device of this invention under control of controller 30. FIG. 7 illustrates the descent of head 101, the attachment of a workpiece from stack 67, and the ascent of head 101 of loading device 50. FIG. 8 continues operation of the loading device from FIG. 7 and illustrates advance of carriage 85 to position head 101 over the machine tool worktable positioning of the workpiece gripping members to a machine tool load position, descent of the head 101 to deposit the workpiece on the worktable and the gauging of the workpiece in the Y axis. FIG. 9 illustrates a further sequencing of the loading device from FIG. 8 to withdraw head 101 from the machine tool worktable and from contact with the workpiece, to withdraw carriage 85 to a position over stack 67 and to gauge the workpiece in the X axis direction.

Figure 10:
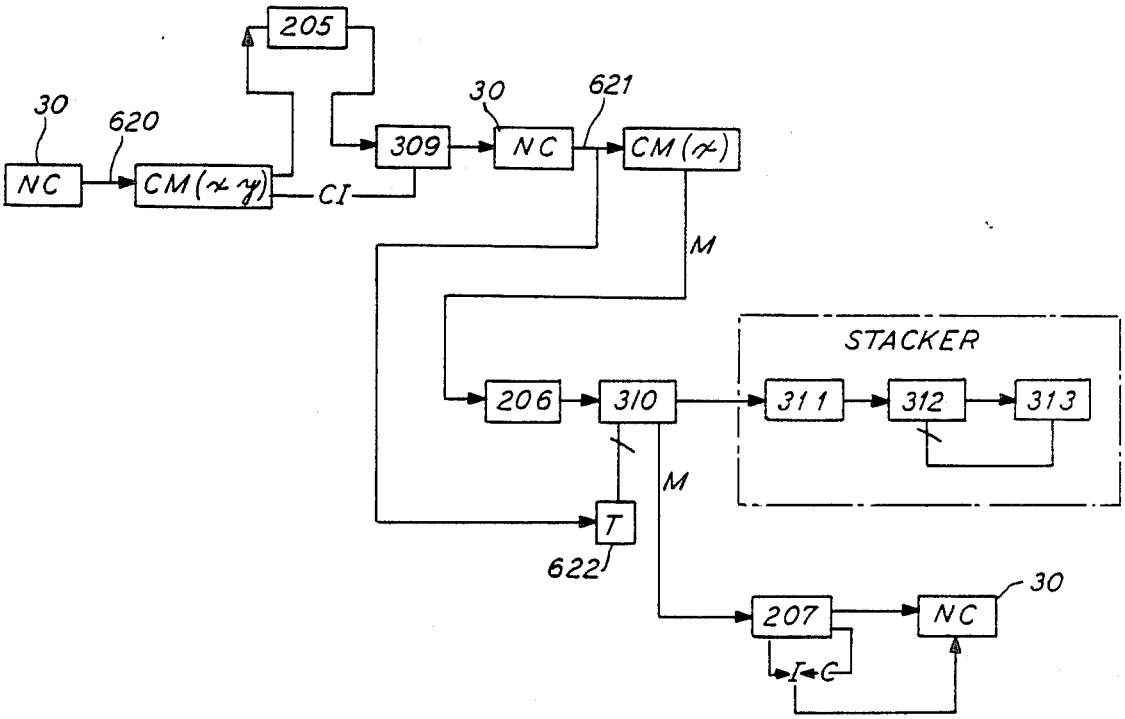
FIG. 10 is a view similar to FIGS. 7 through 9 illustrating an unloading phase.

FIG. 10 illustrates the unloading sequence.

In FIGS. 7 through 10, NC indicates the controller 30, T indicates a time delay clock, M indicates that the effect on the next illustrated device is caused by movement of a device rather than by a signal input. I indicates an inhibit signal preventing actuation of a device, C indicates a cancel signal cancelling an inhibit signal. A (/) mark through a line indicates a signal to return a device to a previous state of activation, (CM) indicates gripper carriage movement in either or both the X and Y directions as indicated.

Operation of the loading device, the gauging devices and the unloading device sequencing takes place in at least four distinct steps. The first step is a loading device ready step during which the loading device head descends over the stack 67, engages the top sheet of the stack and raises it to a carriage transport position. This step is independent of any operation being carried out in connection with the machine tool and can be programmed to run simultaneously with a piece program of the machine tool.

A second step involves transport of the loaded workpiece to a position above the machine tool worktable, movement of the workpiece gripping members to a load position, descent of the head to deposit the workpiece on the worktable, partial disengagement of the workpiece from the head, and workpiece gauging in the Y axis. A third step clamps the workpiece in the workpiece gripping members, withdraws the head to a transport position above the table, withdraws the loading device carriage to a position above the stack 67, moves the workpiece in the X axis direction and gauges it and terminates the load sequence. The fourth step moves the completed workpiece to the unload station of the worktable, disengages the workpiece from the workpiece gripping members, withdraws the workpiece gripping carriage from the tip table section of the worktable, removes the workpiece from the machine tool worktable and deposits it in the stacking device and cycles the stacking device to stack the workpiece in a finished product stack.

The sequence of operations involved in the first step is illustrated in FIG. 7 where the cycle is activated by a signal either generated in the manual mode from a push button 600, or in the automatic mode from the controller 30. The signal is fed to a timing clock 601 and directly from that to valve solenoid 303*a*. Actuation of valve solenoid 303*a* places pressure line 408 in communication with line 415 while venting line 413 to line 410. This causes the loader head 101 to descend into engagement with stack 67. During descent, switch 203 opens providing an inhibit signal preventing actuation of solenoid 301*a* which prevents movement of carriage cylinder 88 to move the carriage 85 away from the overstack position. Descent of the head brings switch 204 into contact with the top sheet of the stack 67 which after a time delay to assure proper seating of the cups 110 on the top sheet of the stack sends a signal to activate solenoid 304*a* which communicates vacuum line 419 to line 401 supplying vacuum to the cups 110. Activation of solenoid 304*a* provides a signal to an and gate 602 which also receives a signal from timer 601 and in the presence of both signals provides a signal to activate solenoid 303*b* while at the same time deactivating solenoid 303*a*. This communicates pressure line 409 to line 413 and through valve 302 to line 414 while at the same time venting line 415 to line 410. In this valve position, head 101 is lifted from engagement with the stack 67 to a transport position above stack 67 thereby closing switch 203. Closure of switch 203 cancels the inhibit on valve solenoid 301*a* and provides a signal to the controller 30 indicating that the loader is now in the loading device ready condition.

FIG. 8 illustrates the second step which is initiated wither by a signal from controller 30, or, in the manual mode, from push button 603. Because operation of step 2 will being the loading device into the area of the machine tool, the signal from controller 30 or from button 603 is prevented from activating the loading device unless certain machine tool table conditions exist. First, as indicated, at 605, the workpiece gripping carriage must be properly positioned in the Y axis direction with switch 205 closed. Movement of the Y direction is under the influence of the controller 30 and was previously accomplished in connection with the unloading cycle prior to actuation of tip table 17. Actuation of tip table 17 had opened switch 207 under control of the controller 30 which had placed an inhibit on further movement of the carriage in either the X or Y axis. If, upon receipt of signal from the button 603 or controller 30, switch 205 does not indicate the proper positioning of the workpiece carriage in the Y axis direction, the controller 30 will cause movement to the proper position unless inhibited by switch 207. Upon closure of switch 205 indicating proper positioning of the workpiece gripping carriage in the Y axis, the signal 607 will cancel activation of solenoid 301*b*, if that solenoid remains actuated from a previous cycling of the loader. At the same time signal 607 will actuate solenoid 301*a* which will cause an initial movement of the cylinder 88 by communicating pressure line 422 with line 424 while venting 427 to line 433. Pressure in line 424 will provide pressure in line 426 unless blocked by pilot valves 305 or 306. Thus, as indicated, valves 305 or 306 can inhibit any movement of cylinder 88 even though solenoid 301*a* is activated. Valve 305 senses head lifting pressure in the bottom of cylinder 105, which, if present indicates that head 101 is raised. Sensing is through pilot line 428. If the head 101 is raised, valve 305 communicates line 424 to line 425. Valve 306 is solenoid operated by controller 30 and will communicate 425 to line 426 unless the controller is in an emergency stop or all hold condition or electric power has failed to the system. In the absence of an inhibit from valves 305 or 306, movement of cylinder 88 will begin to move carriage 85 towards the machine tool. This movement will pass the workpiece suspended from the cups 110 between the double sheet transmitter receiver sensor 209. If a double sheet is detected, an inhibit signal will be sent to terminate the signal to 301*a* and initiate an all hold condition. The inhibit can be cancelled by manual push button 609 upon correction of the double sheet condition. In the absence of an inhibit from switch 209, movement of the carriage 85 deactivates switch 102 producing an in phase condition between switches 201 and 202 during movement of the carriage 85. This in phase condition produces an inhibit on further actuation of solenoid 302*a* preventing inappropriate lowering of head 101. Upon completion of travel of carriage 85, switch 202 is activated eliminating the in phase condition between switches 202 and 202 and providing a cancel to the inhibit of valve 302*a*. Activation of switches 201 and 202 to the proper out-of-phase condition produces a signal to cancel activation of solenoid 303*b* and to activate solenoid 302*a*. Activation of solenoid 302*a* vents line 414 to line 418. At the same time line 415 has previously been vented to line 410 so there is now no pressure being provided to cylinder 105. Therefore head 101 will drop to the machine tool work support table under gravity while forcing any air out of the bottom half of pressure cylinder 105 through restricted orifice 417. This gravity drop feature is desired in that it insures that no force, other than the weight of the head 101, is applied pushing the workpiece against the machine tool workpiece support table. If excess pressure were applied, the workpiece would bottom the anti-friction balls on the machine tool workpiece support table and bring the workpiece to a position below which it would be grabable by the workpiece gripping members. Descent of the head 101 opens switch 203 which provides a signal to timer 612. This timer provides a delay sufficient to allow the workpiece to be deposited on the machine tool workpiece support table and then sends a signal to cancel activation of solenoid 304*a* terminating vacuum supply to the cups 101. Simultaneously a signal is sent activating solenoid 304*b* communicating pressure line 402 through regulator 420 to line 401. This blows air through cups 110 to break suction contact between the cups and the deposited workpiece. While the carriage 85 has been moved from the loader stack area to a position over the workpiece support table, the signal from manual button 603 or the NC 30 which activated that movement has simultaneously provided a signal to valve 309 causing the workpiece gripping members to open and causing workpiece gripping carriage 20 movement in the X axis direction, unless inhibited by 207, to bring the workpiece gripping members to a load position in the X axis direction, at which time switch 206 is closed to provide a signal to the controller 30 indicating that the workpiece gripping members 21 are in the proper position in the X axis direction for receipt of the workpiece being loaded. Proper positioning in the Y axis direction had been previously assured by passage of the signal to initiate movement of the loading device from the ready position through switch 205. The same signal advising the controller 30 that the workpiece gripping members are in the proper position in the X axis direction can be utilized to clear any inhibit on actuation of the valve for side gauge sensor 54.

Upon receipt of signals from timer 612 and switch 206, controller 30 initiates movement of the workpiece gripping carriage in the Y axis direction. Since the carriage had previously been moved to a designated 0 point at the workpiece gripping carriage load position, and since that point is known with the controller, movement in the Y direction is restricted to a pre-set distance, for example 1,5 inches. During this movement, the open gripping members 21 will move into position around the deposited workpiece until the edge of the workpiece contacts sensors 210 located at the back of the workpiece gripping member throats. During this movement, the workpiece, resting on the machine tool worktable will still have the weight of head 101 resting thereon which provides a sufficient resistance to movement of the workpiece on the worktable to prevent the engagement of the workpiece by the gripping members from imparting sufficient movement to the workpiece to cause it to jump away from the workpiece gripping members. At the same time, due to the flexibility of cups 110, movement of the workpiece by contact with the moving workpiece gripping members is allowed so that the workpiece can pivot with respect to the machine tool worktable and to head 101. This pivoting allows the straight edge of the workpiece to engage each of the workpiece gripping members 21 even though the loader may have deposited the workpiece on the machine tool worktable in a canted condition out of parallelism with the workpiece gripping members 21. It has been empirically determined that a movement in the Y axis direction of 1.5 inches is sufficient to insure activation of sensors 210 in each of the workpiece clamping members 21, when the clamping members 21 are of a normal size and when the workpiece has been moved and deposited on the worktable in the generally designated area and generally properly aligned into operative association with the clamping means member 21. However, since alignment of the workpiece on the worktable is, according to this invention, not a critical function of the loader, and since alignment can vary depending upon the positioning of the stack in the loading device and oscillations of the workpiece allowed by the flexibility of the cups 110, other embodiments may require a greater movement in the Y axis. A desired feature of this invention is the fact that proper alignment of the workpiece in the Y axis direction is accomplished by movement of the gripping members against the deposited workpiece on the machine tool worktable and sensing of proper contact between the workpiece and the gripping members 21 by switches 210 which may be pressure switches. Thus, I have eliminated any major criticality relating to the deposit of the workpiece on the workpiece support table while at the same time avoiding the necessity of any complex sideways movements of the loading mechanism to bring the workpiece into the clamping members. Since the distance of movement of the clamping members 21 from the base line to the point of full engagement with the workpiece is known, upon closure of the switches 210 and completion of the movement of the workpiece gripping members in the Y axis direction, the exact positioning of the forward edge of the workpiece with respect to the machine tool center line is known by the controller, since the controller knows that the then positioning of the workpiece grippers in the Y axis direction is 1.5 inches inward from the Y axis zero point. Closure of switches 210 sends a signal to controller 30 indicating that the workpiece has been properly gauged, or positioned in the Y axis direction thereby terminating step 2.

FIG. 9 illustrates step three which once again is initiated by a signal from controller 30 or, in the manual mode from push button 613. That signal cancels activation of solenoid 309 causing the workpiece gripping members 21 to close into engagement with the properly Y axis positioned workpiece. Upon closure of the workpiece gripping members 21, the signal may be used to activate the valve on side gauge sensor 54 to project the sensor above the surface of the workpiece support table. The signal also deactivates solenoid 302*a* which, because valve 302 is a spring biased valve, communicates pressure line 413 with line 414. This raises cylinder 105 to lift head 101 to a transport position above the machine tool worktable. Movement of the head causes switch 204 to rise out of contact with the workpiece thereby indicating that cups 110 are free of the workpiece. Further movement closes switch 203 which produces a signal cancelling activation of solenoid 301*a* and activating solenoid 301*b*. Activation of solenoid 301*b* communicates pressure line 423 with line 427 and vents line 431 through lines 426, 425 and 424 to line 433. This causes retraction of cylinder 88 moving carriage 85 from the position over the machine tool worktable to the position over the loading device stack 67. During this movement switch 202 is initially opened causing an in phase condition between 202 and 201 producing an inhibit on activation of solenoid 302*a* and, if desired, 303*a* preventing downward movement of head 101. Upon completion of movement of cylinder 88, switch 201 is contacted eliminating the in phase condition and cancelling the inhibit. Closure of switch 201 provides a signal which may be used to cancel the signal to 304*b* turning off the blow off air and sending a signal informing the controller that the loading device is clear of the machine tool. The valve for side gauge sensor 54 has been activated to raise the sdie gauge sensor above the workpiece support table 15. The workpiece gripping member carriage 20 is now caused to move in the X axis direction by signal 615. Since the gripping members 21 are closed, the workpiece will be carried in the X axis direction until its leading edge abuts side gauge 54. This abutment of side gauge 54 will cause movement of the side gauge projection, which movement closes switch 208 at a point precisely positioned with respect to the machine tool center line. This precise positioning of the point at which switch 208 is closed during lateral movement of the projecting portion of side gauge 54 allows switch 208 to send a signal to the controller setting the X axis at zero point at the position of the workpiece gripping carriage 20 at that instant. This precisely gauges or positions the workpiece in the X axis irrespective of what point along the X axis length of the workpiece it was gripped by the workpiece gripping members 21. Since the position of switch 208 is known with respect to the machine tool center line, and since the position of the workpiece gripping members at the point of closure of switch 208 is known within the controller, the workpiece has now been precisely gauged in both the X and Y directions. This gauging can be used to send a signal to cancel actuation of the valve for the side gauge projection 54 withdrawing the side gauge to a position below the workpiece support table and allowing free movement of the workpiece over the support table. At the same time a signal is sent to the controller 30 for comparison with the signal from 201. The presence of both signals indicates that step 3 has been completed and the controller can be cycled to its next command initiating the piece program on the workpiece.

Upon completion of step 3, the loading device is once again repositioned over the loader stack 67 and all valves and switches are in the position illustrated in FIG. 6 except that solenoid 301*b* remains activated maintaining the cylinder 88 in the over-stack position. Because of the balanced pressure condition of the spring center point of valve 301, solenoid 301*b* may be deactivated if desired as a final step of cycle 3 from a signal from switch 201. However deactivation is not required since signal 607 of FIG. 8 accomplishes that result.

Upon completion of the piece program, the unloading cycle, step 4, is triggered by the controller 30 as being the next command within the controller upon completion of production run sequence. This command causes a set of signals 620, illustrated in FIG. 10, to be sent to the controls for movement of the workpiece gripping carriage to move the workpiece gripping carriage in both the X and Y axes to a position where the workpiece is positioned over the tip table portion 17. Arrival at this position is sensed by Y position sense switch 205. At the same time, the command which caused the carriage to be moved to the unload position clears any inhibit upon actuation of valve 309 which inhibit has been present throughout the piece program in order to maintain the workpiece in the workpiece gripping members.

Actuation of switch 205 provides a signal to activate valve 309 to open the workpiece gripping members 21. Control 30 is then signaled that the gripping members are open and controller 30 initiates a signal 621 which causes movement of the workpiece gripping carriage in the X axis direction away from the tip table 17 and back to the load position thereby closing switch 206. Closure of switch 206 activates the valve operated tip table cylinder 310 to tip the table segment 17. It can therefore be seen that in order to tip table segment 17 both switches 205 and 206 must be activated to insure that the workpiece is clear of any overhanging portions of the machine tool. The same signal 621 which causes movement of the workpiece gripping carriage in the X axis provides an input to time delay clock 622 which, after a delay, sends a signal to cancel activation of valve operated tip table cylinder 310 thus closing the tip table segment 17.

Activation of valve operated tip table cylinder 310 had opened switch 207 thereby providing an inhibit to the controller 30 preventing any further commands from being issued by the controller 30 during operation of the tip table. Closure of the tip table caused by the signal from time delay clock 622 closes switch 207 cancelling the inhibit on controller 30 and at the same time sending a signal to the controller 30 which may be used to instruct the controller to advance to its next command.

Activation of the tip table 17 causes the workpiece to slide thereoff, as indicated in FIG. 5. Movement of the workpiece is onto the inturned legs of the L-shaped rotatable rails 155. Further movement of the workpiece on the inclined rails 155 brings the leading edge of the workpiece into contact with end wall 154. End wall 154 is equipped with pilot valve 311 which is closed by engagement with the leading edge of the workpiece. Closure of valve 311 operates master valve 312 to open valve 313. Valve 313 activates cylinders 156 to cause rotation of rails 155. Rotation of the rails drops the completed workpiece onto the completed workpiece stack 159 positioned under the unload stacking device 51.

Dropping of the workpiece from the rails 155 disengages contact with valve 311 which terminates signal to valve 312 which in turn terminates the signal to the valves 313 causing cylinders 156 to return to the unrotated position of the rails 155.

It can be seen that the unload stacking device 51 is totally independent of the controller 30 and further, is completely hydraulically or pneumatically operated. These are felt to be desirable advantages in that they reduce the complexity of the control function while at the same time avoiding dual power supply to unload stacking device 51.

It will further be noted that upon the completion of step 4 the workpiece gripping carriage has been moved to the load position on the worktable with switches 205 and 206 closed. It will be appreciated that this effects the actual sequence of step 2 as shown in FIG. 8 in that switch 205 is closed as well as switch 206. Thus the initial signal in step 2 is in normal circumstances, the signal 607 and that portion of signal 630 which activates valve 309 to open the clamps and provide a signal to control 30, and if desired to clear the inhibit to operation of the valve of side gauge sensor 54. Further, it can be seen that the activation of tip table valve 310 in step 4 is the source of the inhibit from switch 207 indicated in FIG. 8. That portion of FIG. 8 included within the dot-dash lines constitutes a duplication circuit to portions of FIG. 10 allowing step 2 to be operated without prior operation of step 4.

It will be further appreciated that although FIGS. 7 through 10 illustrate, diagrammatically, certain sequences of happenings within the operation of the load, workpiece positioning, and unload cycles of this invention, that other sequences of steps be utilized, and further, that other and separate signals may be utilized. For example, separate operating circuits within the controller 30 can be provided whenever a point has been reached that the next successive point is under bar by an inhibit. These operating circuits can be used to automatically back check and clear the inhibit condition. Additionally, other inhibits may be provided, if desired. For example, an inhibit to activation of the machine tool turret and punch ram may be provided during any of cycles 2, 3 and 4. Additionally other sensors may be provided, for example a sensor indicating exhaustion of stack 67 or overfill of the unload stacking device 51.

Thus, the sequences described are only illustrative of a presently preferred embodiment. It is contemplated that other methods of controlling the combinations of a machine tool with an automatic loading device, automatic initial workpiece positioning on the tool worktable and an automatic unloading device will be utilizable by those skilled in the art.

It will therefore be seen from the above that I have provided an automatic machine tool which, under common control automatically: loads a workpiece onto the machine tool worktable from a stack of workpieces, positions the loaded workpiece accurately with respect to the machine tool, gauging it in both X and Y axes, by means other than highly precise movement by the loading device, production runs the workpiece through the machine tool, and unloads the workpiece from the machine tool worktable to a finished workpiece stack.

Although the teachings of my invention have herein been discussed with reference to specific theories and embodiments, it is to be understood that these are by way of illustration only and that others may wish to utilize my invention in different designs or applications.

I claim as my invention:

1. The method of automatically running a machine tool assembly which includes a machine tool and an associated worktable provided with workpiece gripping members movable in at least X and Y axes directions with respect to a work station of the machine tool, the machine tool and gripping members controlled from an automatic control which comprises the steps of: providing a loading device adjacent the worktable, controlling the loading device from the control to cause the loading device to:

(a) segregate a workpiece from a stack of workpieces,
(b) move the workpiece to a generally defined loading area of the worktable and,
(c) deposit the workpiece on the loading area of the worktable, thereafter gauging the workpiece in X and Y axes directions by movement of the workpiece on the worktable under control of the control and sensing the positioning of the workpiece on the worktable as a result of said movement by sensing contact between edges of the workpiece with machine tool assembly associated devices having predetermined positions at the time of sensing providing signals to said control as a result of said sensing indicating proper gauging of the workpiece in X and Y axes directions, controlling further movement of the gripper members by the control utilizing said gauging as a reference for said further movement, production running said workpiece through said machine tool, terminating said production run, moving said workpiece by said gripping members under control of said control to an unload area of the worktable, withdrawing said gripping members from contact with said workpiece, activating an unload device by said control to unload the workpiece from the unload area of the worktable, and repeating the steps of loading, gauging, production running and unloading.

2. The method of automatically running a machine tool assembly including a machine tool, an associated worktable, and workpiece gripping members movable with respect to the machine tool with the movement of the members being under control of a central automatic control which comprises the steps of:

(a) positioning a stack of workpieces adjacent the machine tool worktable,
(b) moving the gripping members under control from the central control to a first predetermined position exterior of a generally defined load area of said worktable,
(c) causing a loading device to segregate a workpiece from the stack and to deposit the segregated workpiece in the load area of the worktable under command from the central control,
(d) opening the gripping members,
(e) moving the gripping members in a first axis direction under control of the central control into the load area to a second predetermined position,
(f) sensing contact between the gripping members and the segregated workpiece caused by movement of the gripping members into the load area to establish a reference within the control for said first axis,
(g) gripping said segregated workpiece by said gripping members at the second predetermined position, (h) thereafter moving the gripping members and segregated workpiece under control of the central control in a second axis direction different than the first axis direction and establishing a reference within the control for said second axis direction as a result of the movement of the segragated workpiece in the second axis direction, (i) thereafter production running the machine tool to act upon the segregated workpiece utilizing the references to reference controlled movement of the gripping members moving the segregated workpiece in the first and second axes, (j) completing the piece program under control of the control, (k) moving the segregated workpiece by control directed movement of the gripping members to an unload area of the worktable, depositing the segregated workpiece at the unload area and withdrawing the gripping members under direction of the control from the unload area, (l) unloading the segregated workpiece from the worktable by an unload means under direction of the control and thereafter automatically repeating steps b through l.

3. The method of claim 2 wherein the reference in the first axis is the predetermined position.

4. The methof of automatically gauging a workpiece on a worktable having automatically controlled workpiece gripping members movable in X and Y axes over the worktable which comprises the steps of: withdrawing the workpiece gripping members to a known position in at least one axis, depositing a workpiece on said worktable, moving the workpiece gripping members a predetermined distance in the one axis, sensing contact between the gripping members and the workpiece upon termination of the movement of the workpiece gripping members by the predetermined distance and as a result of said sensing clamping the workpiece to the workpiece gripping members, and thereafter moving the workpiece in a second axis direction by movement of the gripping members, and gauging the workpiece in the second axis direction as a result of said movement.

5. The method of claim 4 including the step of applying a resistance to movement of the workpiece on the worktable during movement of the gripping members in the first axis direction.

6. The method of working sheet material workpieces by a sheet material working machine tool of the type having at least one work station and a workpiece supporting table adjacent the work station for supporting a workpiece for movement in two axes directions with respect to the work station with workpiece grasping and moving means including gripper means associated with the table for moving the workpiece with respect to the work station to present selected portions of the workpiece to the work station to perform work thereon thereat, the machine tool having an automatic workpiece loading device and an automatic workpiece remainder unloading device associated therewith, said loading and unloading devices, said grasping and moving means and said machine tool being under the control of an automatic control device, which comprises the steps of:

(a) sorting a single workpiece from a store of workpieces and loading the workpiece onto the workpiece supporting table of the machine tool by means of the loading device, said loading of the workpiece being in a general area of the table in a non-fully gauged condition of the workpiece with respect to the work station of the machine tool;

(b) gauging the workpiece on the supporting table by moving the workpiece on the table in at least one axis direction from said general area to a gauged position;

(c) sensing the arrival of the workpiece at the gauged position by contact between an edge of the workpiece and a sensor and inputing a signal to the control device from the sensor;

(d) holding the workpiece at the gauged position by the gripper means with the position of the gripper means known to the control device when the workpiece is at the gauged position and the gripper means are in gripped relation to the workpiece;

(e) thereafter using the known position of the gripper means determined in step (d) as a reference in the control device to control further movement of the gripper means and gripped workpiece;

(f) moving the gripper means in X and Y axes directions to move the workpiece over the table to present selected portions of the workpiece to the work station;

(g) performing work on the workpiece by the machine tool at the work station and thereby removing portions of the workpiece from remaining portions of the workpiece;

(h) moving the remaining portions of the workpiece by the gripper means to an area for unloading;

(i) removing the remaining portions of the workpiece from the table and from the machine tool by the unloading device, and (j) repeating all of the steps (a) through (i) on successive workpieces under control of the control device.

7. The method of claim 6, in which the step of gauging (b) is accomplished by moving the workpiece on the supporting table in two axes directions from said general area to a gauged position.

8. The method of claim 7, in which during the step of gauging (b) the workpiece is moved on the supporting table by the gripper means.

9. The method of claim 8, which includes providing sensors for sensing an edge of the workpiece in each of the X and Y axes when the edge of the workpiece is at a predetermined position in the associated axis, and from the sensor outputting a signal to the control device when the associated edge is at a predetermined position in the associated axis.

10. The method of claim 9, which includes the steps of withdrawing the gripper means to an area away from the general area prior to loading, and after loading moving the gripper means in a first axis direction towards the general area and sensing contact between the gripper means and an edge of the workpiece by a first sensor, moving the gripper means to a predetermined position in the first axis direction and gripping the workpiece by the gripper means at the predetermined position and thereafter moving the gripper means and workpiece in a second axis direction until a second edge of the workpiece contacts a second sensor, outputting a signal from the second sensor to the control device, identifying within the control device the position of the gripper means when the signal is outputted from the second sensor and thereafter using that identified position as a position factor in controlling further movement of the workpiece with respect to the work station.

11. The method of performing work on a sheet workpiece by a controller controlled machine tool having a working station at which a tool acts upon a workpiece, a workpiece support table adjacent to the work station, a workpiece movement gripper assembly having workpiece grippers, and associated with the table and controlled by said controller for controlled movement of the workpiece on the workpiece support table by the gripper assembly to present successive selected portions of the workpiece to the working station, and a loader for loading workpiece sheets a single sheet at a time from a stack of such sheets onto the worktable, which comprises the steps of:

(a) loading a single workpiece sheet onto the worktable and depositing the sheet on the worktable by the loader in a non-fully gauged position of the sheet on the worktable where the relative position of any two edges of the sheet normal to one another is not known to the controller, the relative position being in relation to a base line system for controlled movement of the sheet by the grippers;

(b) moving the workpiece on the worktable under command of the controller by automatic means from the non-fully gauged position to a fully gauged position with the automatic means under the control of the controller;

(c) sensing the arrival of the workpiece at the fully gauged position by sensor means having a position known to the controller at the time of sensing and inputting a signal to the controller from the sensor means, the signal indicating the presence of at least a portion of the sheet at the sensor means position, the fully gauged position being a position where the position of at least portions of two edges of the sheet normal to one another are known to the controller;

(d) the grippers gripping the workpiece at the fully gauged position with the position of the gripper assembly known to the controller when the workpiece is at the fully gauged position and the grippers are gripping the workpiece;

(e) and thereafter moving the workpiece on the worktable relative to the work station by causing movement of the gripper assembly under command of the controller using the position of the gripper assembly at the position of step (d) as a reference position for the controller for commanding said last mentioned movement.

12. The method of claim 11, including the step of (f) moving the workpiece from the non-fully gauged position to the fully gauged position in two discrete movements, each of which is in only one axis direction and where the relative position of one of the two edges is known to the controller by reason of a said one edge having contacted a sensor prior to the second of the discrete movements, the second of the discrete movements being along the axis of said one edge.

13. The method of claim 12, including the step of (g), in a first of the discrete movements moving the workpiece from the non-fully gauged position to a partially gauged position where at least a portion of one edge of the workpiece is in a position known to the controller.

14. The method of claim 13 wherein the automatic means includes the gripper assembly, and (h) moving the workpiece from said non-fully gauged position to said partially gauged position assembly by operator said gripper assembly.

15. The method of claim 14, including the steps of (i) causing the first of the discrete movements by pushing the workpiece from the non-fully gauged position by the grippers and terminating the first of the discrete movements when the grippers are positioned at a predetermined position, and sensing said one edge position by sensor means carried by the gripper assembly, and (j) thereafter gripping the workpiece by the grippers at the partially gauged position.

16. The method of claim 15, including (k) releasing the loader from the sheet after the first of the discrete movements.

17. The method of claim 16, including the steps of (1) causing a second of the discrete movements by moving the workpiece from the partially gauged position to the fully gauged position by movement of the grippers subsequent to step (j) and continuing said second of the discrete movements until an edge normal to the one edge contacts said sensor means having a relative position known to the controller, and (m) thereafter using the position of the grippers at the time of said last mentioned sensor contact as the reference position for further movement of the grippers under command from the controller.

18. A method of processing and handling a workpiece in a fully automatic machine tool under the control of a controller, comprising the steps of:

separating a sheet of material from a stack of material adjacent a worktable for the machine tool;

moving the separated sheet to a first position on the worktable in an ungauged position;

moving the sheet on the worktable from the ungauged position to a fully gauged position automatically by means under the control of said controller;

sensing the presence of the sheet at the fully gauged position by sensors carried in association with the worktable;

locating within the controller the position of grippers when the sheet is at the sensed fully gauged position by inputing a signal to the controller from the sensors, the controller knowing the position of the grippers when the signal is inputed;

causing the grippers to grip the sheet at said sensed fully gauged position with the grippers at a position which is the position located within the controller;

moving the sheet with respect to the work station of the machine tool by the grippers and performing work on the sheet by the machine tool with the controller referencing movement of the grippers in relation to the position of the grippers as located in the controller.

19. A method according to claim 18, wherein there is the ungauged position, a partially gauged position and said gauged position, and causing movement of said sheet from the ungauged position to the partially gauged position at least in part by contact with the grippers.

20. A method according to claim 18, wherein movement of the sheet from the partially gauged position to the gauged position is caused at least in part by actuating said grippers.

21. A method according to claim 18, wherein the gripping of the workpiece by the grippers is effected in one axis direction prior to movement of the workpiece to the fully gauged position.

22. A method according to claim 18, wherein the workpiece is moved on the worktable in each of X and Y axes from the partially gauged position to the fully gauged position.

23. A method according to claim 18, wherein the automatically moving step comprises a first movement from the ungauged position to a partially gauged position, the first movement being along a single axis.

24. A method according to claim 23, comprising a second movement from the partially gauged position to the fully gauged position, the second movement being along a single axis different from the single axis of the first movement.

25. A method according to claim 18, herein the gripping of the workpiece with the grippers is effected in one axis direction prior to movement of the workpiece to the fully gauged position.

26. A method of processing and handling a workpiece in stages in a fully automatic machine tool, and with a controller controlling the charging and removal of the workpieces onto or away from the machine tool and the handling of the workpiece in the machine tool, including charging a workpiece individually from a stack of the workpieces onto a worktable, acting upon the workpiece by means of a tool at a work station associated with the worktable, handling the workpiece by means of grippers which are movable in the X and Y axis relative to the worktable while selected portions of the workpiece are moved into the work station, removing the workpiece from the worktable after acting on the workpiece by the machine tool, and coordinating the processing and handling stages with each other by the controller, comprising:

depositing the workpieces freely on the work table in a general area thereof in a not fully gauged position adjacent to workpiece grippers;

automatically moving the workpiece on the worktable from said general area by command of the controller to a fully gauged position in accordance with signals from a gauge arrangement associated with the worktable;

sensing the presence of the workpiece at the fully gauged position by engagement with sensors; and gripping the workpiece at the fully gauged position with the grippers imparting knowledge of the position of the grippers relative to the workpiece to the controller when the workpiece is at the fully gauged position.

* * * * *

UNITED STATES PATENT AND TRADEMARK OFFICE

CERTIFICATE OF CORRECTION

PATENT NO. : 4,709,605

DATED : December 1, 1987

INVENTOR(S) : Stephen C. Clark

It is certified that error appears in the above—identified patent and that said Letters Patent is hereby corrected as shown below:

Column 1, line 43, "become" should read --became--.
Column 2, line 11, "wool" should read --tool--.
Column 3, line 53, "unloaded" should read --unload--.
Column 4, line 57, "Engagment" should read --Engagement--.
Column 5, line 57, "interfernece" should read --interference--.
Column 7, line 36, "buttom" should read --bottom--.
Column 9, line 28, "detect of the presence" should read --detect the presence--.
Column 9, line 34, "or" should read --on--.
Column 12, line 34, "wither" should read --either--.
Column 12, line 36, "being" should read --bring--.
Column 13, line 22, "202 and 202" should read --201 and 202--.
Column 14, line 10, "example 1,5 inches" should read --example 1.5 inches--.
Column 15, line 39, "sdie" should read --side--.
Column 17, line 37, "steps be" should read --steps can be--.
Column 19, line 27, "methof" should read --method--.

Signed and Sealed this

Nineteenth Day of September, 1989

*Attest:*

DONALD J. QUIGG

*Attesting Officer*

*Commissioner of Patents and Trademarks*